US005090380A

United States Patent [19]

Suzuki et al.

[11] Patent Number: 5,090,380

[45] Date of Patent: Feb. 25, 1992

[54] IDLING SPEED ADJUSTMENT SYSTEM FOR ENGINE

[75] Inventors: Kazuo Suzuki; Fusao Tachibana, both of Saitama; Mitsugi Chonan, Ibaraki, all of Japan

[73] Assignee: Fuji Jukogyo Kabushiki Kaisha, Tokyo, Japan

[21] Appl. No.: 601,135

[22] Filed: Oct. 23, 1990

[30] Foreign Application Priority Data

Nov. 16, 1989 [JP] Japan ..... 1-299999

[51] Int. Cl.[5] ..... F02M 3/00

[52] U.S. Cl. ..... 123/339

[58] Field of Search ..... 123/339, 352, 361, 585, 123/354

[56] References Cited

U.S. PATENT DOCUMENTS 4,770,140 9/1988 Kiuchi et al. ..... 123/339
4,771,749 9/1988 Kiuchi et al. ..... 123/339
4,903,660 2/1990 Sogawa ..... 123/339
4,951,627 8/1990 Watanabe et al. ..... 123/339
4,955,341 9/1990 Trombley et al. ..... 123/339
4,955,342 9/1990 Tohmiya ..... 123/339

*Primary Examiner*—Raymond A. Neill
*Attorney, Agent, or Firm*—Beveridge, DeGrandi & Weilacher

[57] ABSTRACT

An idling speed adjustment system for an engine, in which a pulse width for corrected fuel injection in the idling operation of the engine is set by adjusting idling adjustment means adapted to be adjusted from outside the system. Subsequently, a pulse width for fuel injection in the idling operation is determined in such a way that a pulse width for basic fuel injection which is set on the basis of a throttle opening degree and engine speed is corrected with several correction values which are set on the basis of detected engine state parameters, and the idling-operation corrected fuel injection pulse width which is set as described above.

6 Claims, 5 Drawing Sheets

IDLING SPEED ADJUSTMENT SYSTEM FOR ENGINE

BACKGROUND OF THE INVENTION

The present invention relates to an idling speed (revolutions per minute) adjustment system for an engine in which the quantity of fuel injection during idling is adjusted so as to stabilize the idling speed of the engine.

Recently, some of two-cycle engines etc. adopt an injector for the fuel feed system thereof so as to enhance response, not only in a higher speed range, but also in lower and medium speed ranges, and simultaneously to enhance the purification rate of exhaust gas emission.

In general, in case of setting the quantity of fuel injection of an injector, the speed of an engine and the quantity of intake air detected by an intake air quantity sensor are set as parameters as disclosed in, for example, the official gazette of Japanese Utility Model Registration Application Laid-open No. 169117/1983, or the speed of an engine and the pressure of the lower stream side of a throttle valve detected by a pressure sensor are set as parameters as disclosed in, for example, the official gazette of Japanese Patent Application Laid-open No. 255543/1988.

In addition, a so-called "$\alpha$-N control system" is known wherein as disclosed in, for example, the official gazette of Japanese Patent Application Laid-open No. 29039/1988, the quantity of intake air is conjectured from the speed N of an engine and the opening degree $\alpha$ of a throttle valve detected by a throttle opening-degree sensor.

The $\alpha$-N control system can be structurally simplified and is superior in point of cost to the extent that the intake air quantity sensor, the pressure sensor or the like is dispensed with. Therefore, it is oftener adopted for two-cycle engines etc.

Meanwhile, the quantity of intake air passing through the throttle valve in the idle running operation, namely, in a fully-closed throttle condition is small, so that it is liable to disperse every product due to the machining error of a throttle body, etc. Besides, the detection value of a fully-closed throttle region based on the throttle opening-degree sensor is liable to fluctuate due to the assemblage error of this throttle opening-degree sensor, the secular change thereof, etc.

As a result, a difference arises between the quantity of intake air conjectured on the basis of the throttle opening degree $\alpha$ and the engine speed N and the actual quantity of intake air passing through the throttle valve. Accordingly, the electronic control engine which adopts the $\alpha$-N control system has the problem that an appropriate air-fuel ratio cannot be set, so the idling state is rendered unstable.

SUMMARY OF THE INVENTION

The present invention has been made in view of the above circumstances, and has for its object to provide an idling speed adjustment system for an engine which can appropriately set an air-fuel ratio in the idling state of the engine to stabilize the idling speed thereof.

In order to accomplish the object, the idling speed adjustment system for an engine according to the present invention comprises idling adjustment means externally adjustable; idling-operation corrected fuel injection pulse width setting means for setting a pulse width for corrected fuel injection in an idling operation, on the basis of an output signal of said idling adjustment means; basic fuel injection pulse width setting means for setting a pulse width for basic fuel injection, on the basis of a throttle opening degree and engine speed and fuel injection pulse width setting means for setting a fuel injection pulse width in the idling operation in such a way that the basic fuel injection pulse width which is set by said basic fuel injection pulse width setting means is corrected with correction values which are set on the basis of detected engine state parameters, and the idling-operation corrected fuel injection pulse width which is set by said idling-operation corrected fuel injection pulse width setting means.

With the above construction, when the idling adjustment means is adjusted from outside the system, the idling-operation corrected fuel injection pulse width is set on the basis of the output signal of this idling adjustment means.

Further, the fuel injection pulse width in the idling operation is set in such a way that the basic fuel injection pulse width which is set on the basis of the throttle opening degree and the engine speed is corrected with the several correction values which are set on the basis of detected engine state parameters, and the idling-operation corrected fuel injection pulse width which is set as described above.

PREFERRED EMBODIMENTS OF THE INVENTION

Now, the embodiments of the present invention will be described with reference to the drawings.

Construction of Engine Control System

Figure 2:
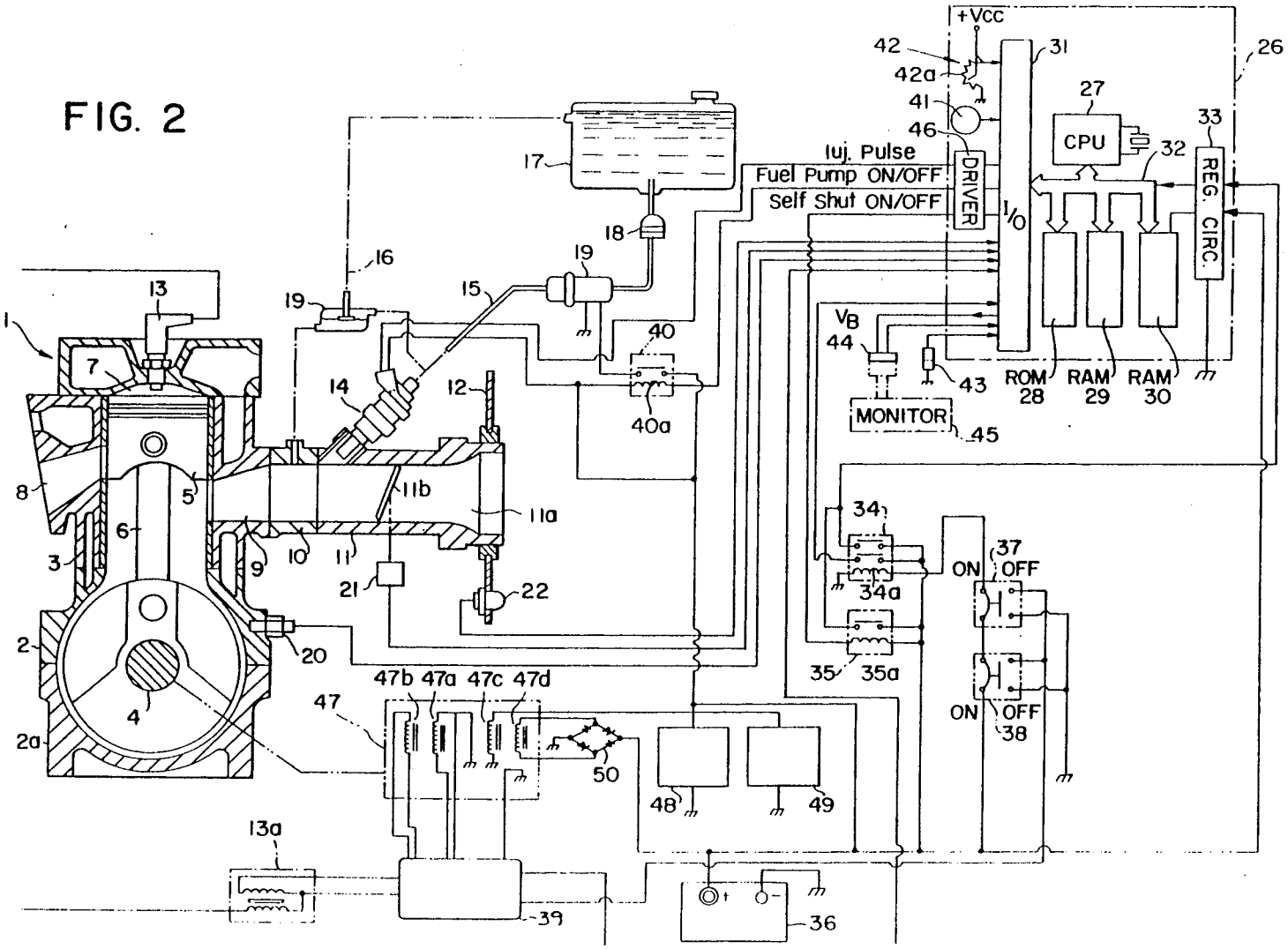
FIG. 2 is a schematic diagram of an engine control system.

Numeral 1 in FIG. 2 designates the engine proper of a two-cycle engine which is installed on a snow-mobile or the like. A cylinder block 3 is fixedly mounted on the crankcase 2 of the engine proper 1. Further, a crankshaft 4 is extended perpendicularly to the cylinder block 3 inside a crank chamber 2*a* which is defined by the crankcase 2 and which serves also as a supercharging chamber. In addition, a piston is joined to the cranksahft 4 through a connecting rod 6. Besides, a combustion chamber 7 is formed over the piston 5 of the engine proper 1, and it is held in communication with the crank chamber 2*a* through a scavenging passage, not shown.

An exhaust port 8 provided in the cylinder block 3 and the unshown scavenging passage are respectively openable to the combustion chamber 7 and the crank chamber 2*a* in the reciprocating motion of the piston 5 with this piston functioning as a valve.

An intake port 9 is provided in the cylinder block 3, and it can communicate with the crank chamber 2a at a predetermined timing through a reed valve not shown or through a rotary valve adapted to rotate synchronously with the crankshaft 4. In addition, a throttle body 11 is fixed to the open end of the intake port 9 through an insulator 10, and an air box 12 for accommodating an air cleaner, not shown, is fixed to the air horn 11a of the throttle body 11. Numeral 13 indicates an ignition plug, which is connected to the secondary side of an ignition coil 13a.

An injector 14 is confronted to the lower stream side of the throttle valve 11b of the throttle body 11 A fuel tank 17 is held in communication with the injector 14 through a fuel passage 15 as well as a fuel return passage 16. Further, a fuel filter 18 and a fuel pump 19 are incorporated in the fuel passage 15 in this order as viewed from the side of the fuel tank 17, while a pressure regulator 23 by which the differential pressure between the pressure of the lower stream side of the throttle valve 11b and the pressure of fuel in the fuel passage 15 is held constant is incorporated in the fuel return passage 16.

A crankcase temperature sensor 20 is fixedly mounted on the crankcase 2, a throttle opening-degree sensor 21 is joined to the throttle valve 11b, and an intake-air temperature sensor 22 is confronted to the air box 12.

Circuit Arrangement of Control Apparatus

Meanwhile, numeral 26 designates a control apparatus (electronic control unit abbreviated to "ECU") which is constructed of a microcomputer. The CPU (central processing unit) 27, ROM 28, RAM 29, backup RAM 30 and I/O interface 31 of the ECU 26 are interconnected through a bus line 32, and they have a voltage regulator circuit 33 connected thereto.

A battery 36 is connected to the voltage regulator circuit 33 through those relay contacts of a ECU relay 34 and a self-shut relay 35 which are connected in parallel with each other. The battery 36 feeds controlling supply voltages to the constituent units of the ECU 26, and a backup supply voltage to the backup RAM 30.

The ECU relay 34 has one pair of relay contacts, and the magnet coil 34a thereof is connected to the battery 36 through a kill switch 37 as well as an ignition switch 38. In addition, the respective ON terminals of the kill switch 37 and ignition switch 38 are connected in series, while the respective OFF terminals are connected in parallel. When both the switches 37 and 38 are in their ON positions as depicted in the figure, the ECU relay 34 turns ON to feed the controlling supply voltage to the voltage regulator circuit 33 through one of its contacts.

When either of the kill switch 37 and ignition switch 38 is OFF, lines which are laid from a CDI unit 39 being an ignition device are short-circuited, and the ignition plug 13 misfires to stop the engine.

Incidentally, the kill switch 37 is a switch for emergency stop which is disposed in, e.g., the grip of the unshown snowmobile.

One end of the magnet coil 35a of the self-shut relay 35, that of the injector 14, that of the magnet coil 40a of a fuel pump relay 40 and the relay contact of this fuel pump relay 40 are respectively connected to the battery 36. Further, the fuel pump 19 is connected to the relay contact of the fuel pump relay 40.

The self-shut relay 35 serves to feed the supply voltage to the ECU 26 for a preset period of time (for example, 10 minutes) even after either of the kill switch 37 and ignition switch 38 has been turned OFF to stop the engine. Thus, while the self-shut relay 35 is held ON since the stop of the engine, starting-mode increased-quantity corrections are not made, and the engine is prevented from becoming difficult of starting due to an overrich air-fuel ratio in a hot restarting mode.

The sensors 20, 21 and 22 mentioned before and an atmospheric pressure sensor 41 built in the ECU 26 are connected to the input ports of the I/O interface 31 of the ECU 26. Also connected to the input ports of the I/O interface 31 are a signal line for receiving CDI pulses from the CDI unit 39, and the other relay contact of the ECU relay 34 for monitoring the terminal voltage $V_B$ of the battery 36.

Further, one end of an idling adjustment resistor 42a included in idling adjustment means 42 is connected to the input port of the I/O interface 31. The idling adjustment means 42 is a potentiometer by way of example, and a regulated voltage source $V_{CC}$ is connected to a movable contact which is held in sliding contact with the idling adjustment resistor 42a.

Figure 3:
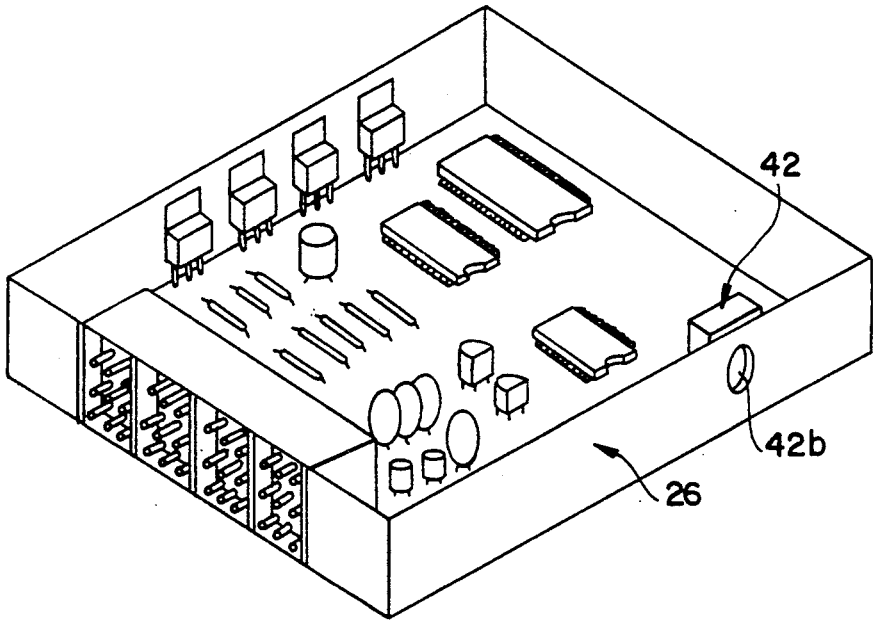
FIG. 3 is an exterior view of the control apparatus.

As shown in FIG. 3, an adjustment knob 42b for fixing the movable contact of the idling adjustment means 42 is exposed to the side surface of the ECU 26. The output voltage $V_{MR}$ of the idling adjustment means 42 is variably set by turning the adjustment knob 42b.

Referring back to FIG. 2, a trouble diagnosis mode changing-over connector 43 for changing-over the self-diagnostic function of the ECU 26 between a U check mode (user check mode) and a D check mode (dealer check mode), and a trouble diagnosing connector 44 are connected to the input ports of the I/O interface 31. When any trouble has occurred, an automobile diagnosing serial monitor 45 indicated by a two-dot chain line in the figure is connected to the trouble diagnosing connector 44 so as to diagnose the trouble.

Usually, the trouble diagnosis mode changing-over connector 43 is kept in the U check mode. When any abnormality has arisen in the system, the trouble data thereof is stored and held in the backup RAM 30.

In the service station of a dealer, etc., the serial monitor 45 is connected to the trouble diagnosing connector 44, and the trouble data is read out so as to diagnose the trouble. On this occasion, when the trouble diagnosis mode changing-over connector 43 is transferred to the D check mode, the trouble can be diagnosed in more detail.

Meanwhile, the other end of the injector 14, that of the magnet coil 40a of the fuel pump relay 40, and that of the magnet coil 35a of the self-shut relay 35 are respectively connected to the output ports of the I/O interface 31 through a driver circuit 46.

In the CPU 27, the value N of engine speed is calculated from the interval of the CDI pulses in accordance with a control program stored in the ROM 28, and a basic fuel injection pulse width $T_p$ for the injector 14 is set on the basis of the engine speed N and a throttle opening degree $\alpha$ detected by the throttle opening-degree sensor 21. Further, the basic fuel injection pulse width $T_p$ is subjected to several kinds of corrections on the basis of several kinds of data items stored in the RAM 29, thereby to compute a fuel injection pulse width $T_i$.

The exciter coil 47a and pulser coil 47b of a magneto 47 which is driven by the cranksahft 4 of the engine proper 1, and the primary side of the ignition coil 13a are connected to the CDI unit 39. The ignition plug 13 connected to the secondary side of the ignition coil 13a is caused to spark every predetermined timing by the CDI unit 39.

The magneto 47 is further furnished with a lamp coil 47*c* and a charge coil 47*d*. The lamp coil 47*c* is connected to an A.C. regulator 48, the A.C. output of which is controlled to a constant voltage and is supplied to an electric load 49 such as lamp or heater not shown. Besides, the A.C. output of the charge coil 47*d* is subjected to full-wave rectification by a rectifier 50, whereupon the battery 36 is charged with the resulting voltage.

Functional Construction of Control Apparatus

Figure 1:
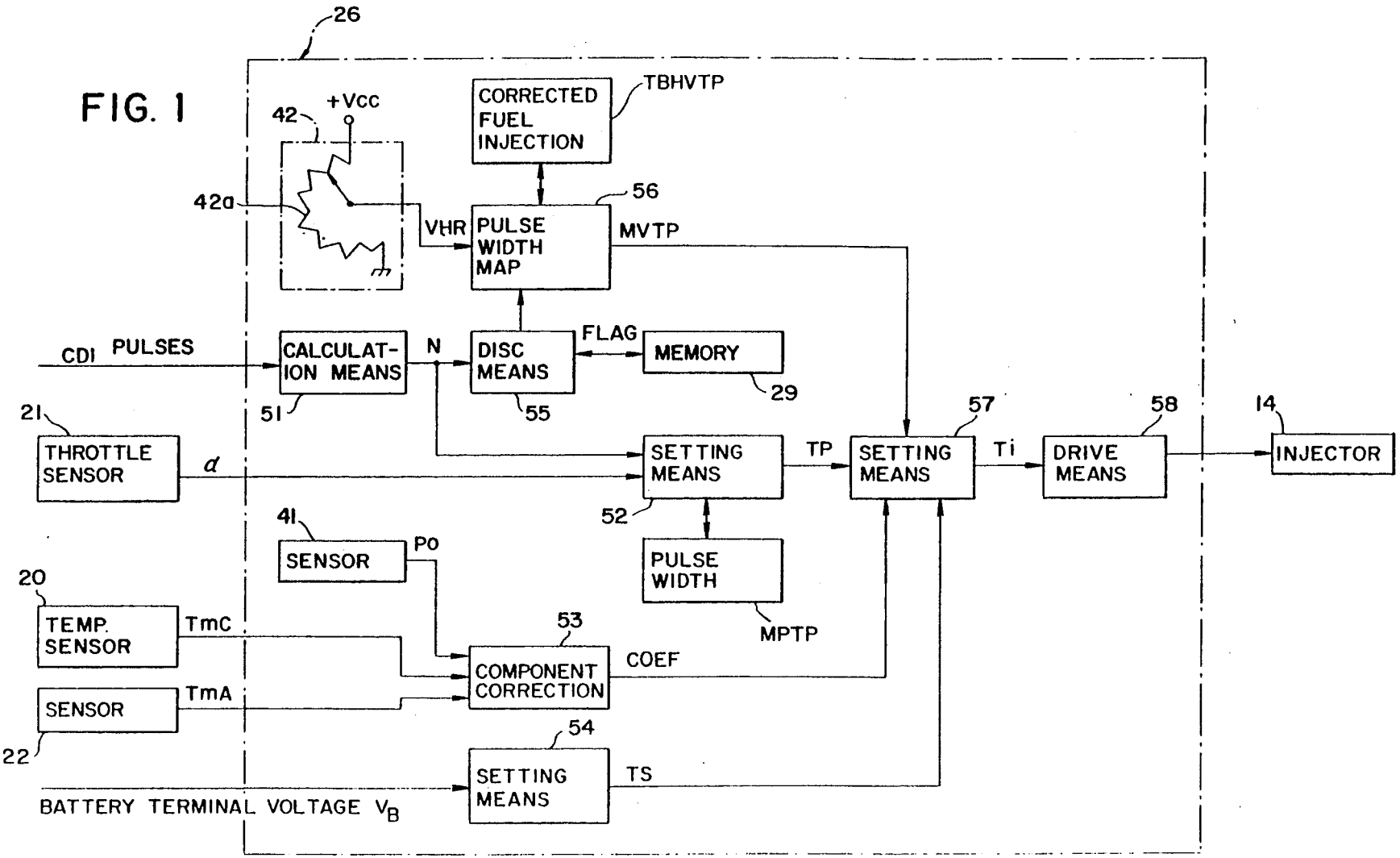
FIG. 1 is a functional block diagram of a control apparatus.

As shown in FIG. 1, the functions of computing fuel injection pulse widths in the ECU 26 are fulfilled by engine speed calculation means 51, basic fuel injection pulse width setting means 52, increased-quantity component correction coefficient setting means 53, injector voltage correction pulse width setting means 54, idling state discrimination means 55, idling-operation corrected fuel injection pulse width setting means 56, fuel injection pulse width setting means 57 and injector drive means 58.

The engine speed calculation means 51 calculates the engine speed N on the basis of the CDI pulses which are output from the CDI unit 39.

In, for example, a three-cycle engine, the CDI pulse is provided every 120°. Therefore, a period $f=_{d\theta 120^\circ \cdot dt120^\circ}$ is evaluated from the elapsed time t120° between the CDI pulses, and the engine r.p.m. N is calculated on the basis of the period f ($N=60/(2\pi \cdot f)$).

The basic fuel injection pulse width setting means 52 finds a basic fuel injection pulse width $T_p$ directly or through an interpolational computation from a basic fuel injection pulse width map $MP_{TP}$, with parameters being the engine speed N calculated by the engine speed calculation means 51 and a throttle opening-degree ($\alpha$) signal from the throttle opening-degree sensor 21.

The quantity Q of intake air passing through the throttle valve 11*b*, and the engine speed N as well as the throttle opening degree $\alpha$ on that occasion are in the relationship of a certain function. In addition, the basic fuel injection pulse width $T_p$ can be evaluated in terms of $T_p=K \cdot Q/N$ for a constant air-fuel ratio. The basic fuel injection pulse width $T_p$ can accordingly be obtained by an experiment or the like beforehand, using the engine speed N and the throttle opening degree $\alpha$ as the parameters.

The increased-quantity component correction coefficient setting means 53 sets a coefficient COEF for air-fuel ratio corrections corresponding to air density factors required in setting an air-fuel ratio, namely, for corrections corresponding to several increased-quantity components, on the basis of an atmospheric pressure $P_0$ detected by the atmospheric pressure sensor 41, a crankcase temperature $T_{mC}$ detected by the crankcase temperature sensor 20, and an intake-air temperature $T_{mA}$ detected by the intake-air temperature sensor 22.

In this regard, in the case of the two-cycle engine, the intake air once stays in the crank chamber 2*a* serving also as the supercharging chamber, and it is therefore susceptible to the temperature of the crankcase 2. Accordingly, when the correction coefficient corresponding to the density of the actual intake air which is fed into the combustion chamber 7 is to be set, the crankcase temperature $T_{mC}$ is required as the parameter in addition to the atmospheric pressure $P_0$ (the correction for an altitude) and the intake-air temperature $T_{mA}$.

The injector voltage correction pulse width setting means 54 reads the ineffective injection pulse width of the injector 14 from an unshown table in accordance with the terminal voltage $V_B$ of the battery 36, and it sets an injector voltage correction pulse width $T_s$ which interpolates the ineffective injection pulse width.

The idling state discrimination means 55 discriminates if the current running state of the engine is an idling state, in such a way that the value of the engine speed N calculated by the engine speed calculation means 51 is compared with a preset idling deciding reference speed value in accordance with the status of an idling state change-over discriminating flag FLAG which is stored in the memory means 29.

The idling state change-over discriminating flag FLAG is reset (FLAG=0) when the value of the engine speed N exceeds the idling state, while it is set (FLAG=1) when the value of the engine speed N falls within the idling state. The reset (FLAG=0) and set (FLAG=1) statuses of the flag are stored in the predetermined addresses of the memory means (RAM) 29.

In the case where the flag is in the status of FLAG=0, namely, where the last sampled value of the engine speed N is in excess of the idling state, the idling state discrimination means 55 compares the idling deciding reference speed $N_L$ (for example, $N_L \cdot =1000$ r.p.m.) and the engine speed N calculated by the engine speed calculation means 51, and it decides the idling for $N \leqq N_L$.

On the other hand, in the case where the flag stored in the memory means 29 is in the status of FLAG=1, namely, where the last sampled value of the engine speed N is in the idling state, the discrimination means 55 compares the value of the idling deciding reference speed $N_L$ with a predetermined offset value A (corresponding to 1 bits by way of example) added thereto and the engine speed N calculated by the engine speed calculation means 51, and it decides the idling for $N \leqq N_L+A$.

Figure 4:
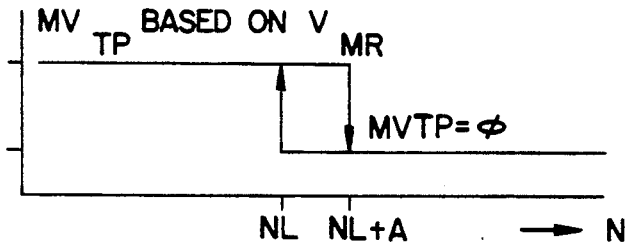
FIG. 4 is a conceptual diagram showing a hysteresis in the case of discriminating an idling state.

In this manner, a hysteresis corresponding to the offset value A is established depending upon whether the last sampled state of the engine lies within or outside the idling state. Thus, control hunting ascriable to the detection error of the engine speed is prevented (refer to FIG. 4).

In the case where the idling state discrimination means 55 has decided the idling state, the idling-operation corrected fuel injection pulse width setting means 56 evaluates an idling-operation corrected fuel injection pulse width $MV_{TP}$ directly or through an interpolational computation in view of an idling-operation corrected fuel injection pulse width table $TB_{MVTP}$, using the terminal voltage $V_{MR}$ of the idling adjustment resistor (MR) of the idling adjustment means 42 as a parameter.

Figure 5:
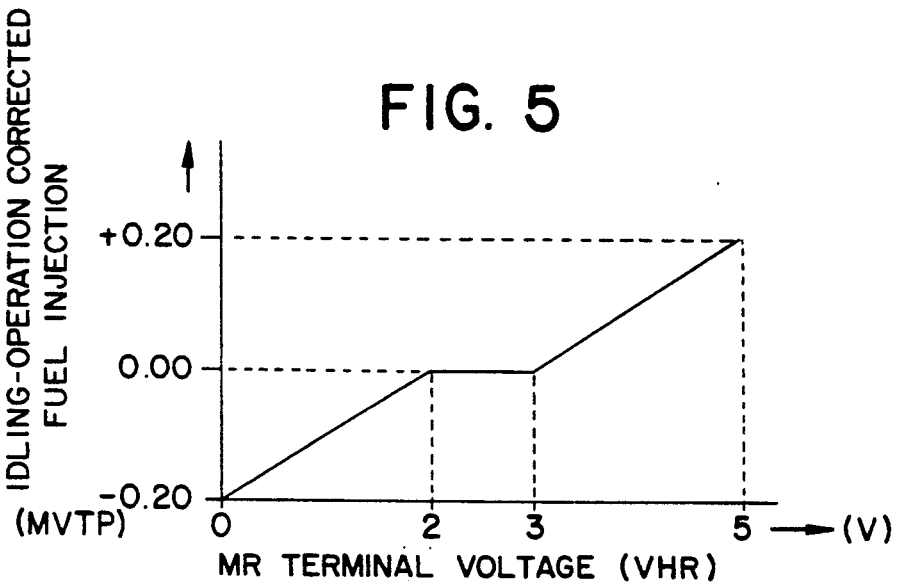
FIG. 5 is a conceptual diagram of the table of pulse widths for corrected fuel injection in an idling operation.

As shown in FIG. 5, the idling-operation corrected fuel injection pulse width table $TB_{MVTP}$ is such that the idling-operation corrected fuel injection pulse width $MV_{TP}$ corresponding to the MR terminal voltage $V_{MR}$ has been evaluated by an experiment or the like beforehand. In the illustrated example, the range of the MR terminal voltage $V_{MR}$ is set at 0–5 V, and the lower limit value ($V_{MR}=0$ V) of the idling-operation corrected fuel injection pulse width $MV_{TP}$ is set at −0.20, while the upper limit value ($V_{MR}=5$ V) thereof is set at +0.20. Further, the idling-operation corrected fuel injection pulse width $MV_{TP}$ with in a range of $V_{MR}=2$–3 V is set at 0.00. The set values are stored in the series of addresses of the idling-operation corrected fuel injection pulse width table $TB_{MVTP}$ which uses the MR terminal voltage $V_{MR}$ as a parameter.

In the case where the idling state discrimination means 55 has decided that the value of the engine speed N exceeds the idling state, the idling-operation corrected fuel injection pulse width setting means 56 sets the idling-operation corrected fuel injection pulse width $MV_{TP}$ at 0.00.

In the fuel injection pulse width setting means 57, the idling-operation corrected fuel injection pulse width $MV_{TP}$ set by the idling-operation corrected fuel injection pulse width setting means 56 is added to the basic fuel injection pulse width $T_p$ set by the basic fuel injection pulse width setting means 52, and the resulting sum $(T_p+MV_{TP})$ is multiplied by the increased-quantity component correction coefficient COEF which has been set by the increased-quantity component correction coefficient setting means 53. Further, the injector voltage correction pulse width $T_s$ set by the injector voltage correction pulse width setting means 54 is added to the resulting product $((T_p+MV_{TP})\times COEF)$. Thus, the setting means 57 sets a fuel injection pulse width $T_i$ $(T_i=(T_p+MV_{TP})\times COEF+T_s)$.

Subsequently, a driving pulse which corresponds to the fuel injection pulse width $T_i$ set by the fuel injection pulse width setting means 57 is delivered from the injector drive means 58 to the injector 14.

Figure 6:
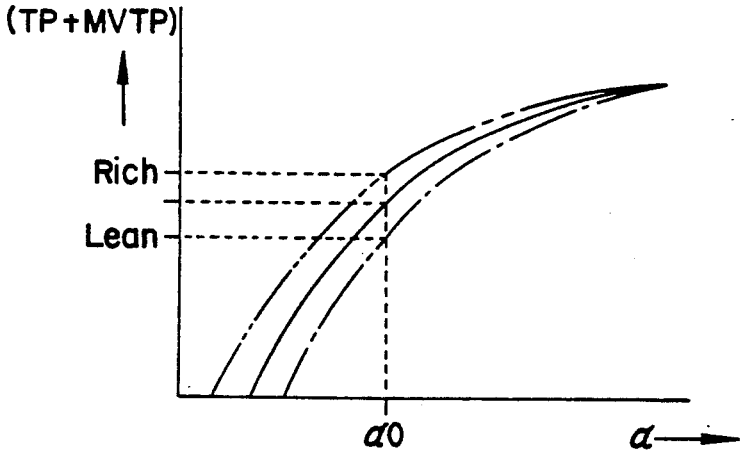
FIG. 6 is a diagram showing the adjustment range of pulse widths for basic fuel injection in a certain idling state.

Meanwhile, in a case where the engine speed N is held constant irrespective of load fluctuations, the sum $(T_p+MV_{TP})$ exhibits characteristics as shown in FIG. 6 versus the throttle opening degree $\alpha$. More specifically, a solid line in the figure indicates the characteristic in the case where the idling-operation corrected fuel injection pulse width $MV_{TP}$ is set at 0, and a dot-and-dash line and a two-dot chain line in the figure indicate the characteristics for $MV_{TP}=-0.20$ and for $MV_{TP}=+0.20$, respectively. When the throttle opening degree $\alpha$ detected by the throttle opening-degree sensor 21 is $\alpha=\alpha_0$, the above value $(T_p+MV_{TP})$ in this region is adjustable within the limits of "Lean" and "Rich" indicated in the figure.

The basic fuel injection pulse width $T_p$ is set greater as the throttle opening degree $\alpha$ enlarges more. Since, however, the adjustable range of the idling-operation corrected fuel injection pulse width $MV_{TP}$ is constant at all times, an adjustable range based on the idling-operation corrected fuel injection pulse width $MV_{TP}$ becomes relatively wider in a region where the throttle opening degree E is smaller. On the other hand, the dispersion of the quantity of intake air passing through the throttle valve 11*b*, which is ascribable to the detection error of the throttle opening-degree sensor 21 or the fabrication error of the throttle body 11, exerts a great influence on the controllability of the air-fuel ratio in an idle running region where the engine speed N is comparatively small.

The error of air-fuel ratio setting in the idle running region is corrected with the idling-operation corrected fuel injection pulse width $MV_{TP}$ the adjustable range of which can be set comparatively wide, whereby the fuel injection pulse width setting means 57 can appropriately set the fuel injection pulse width $T_i$ corresponding to the actual quantity of intake air.

Operation

Figure 7:
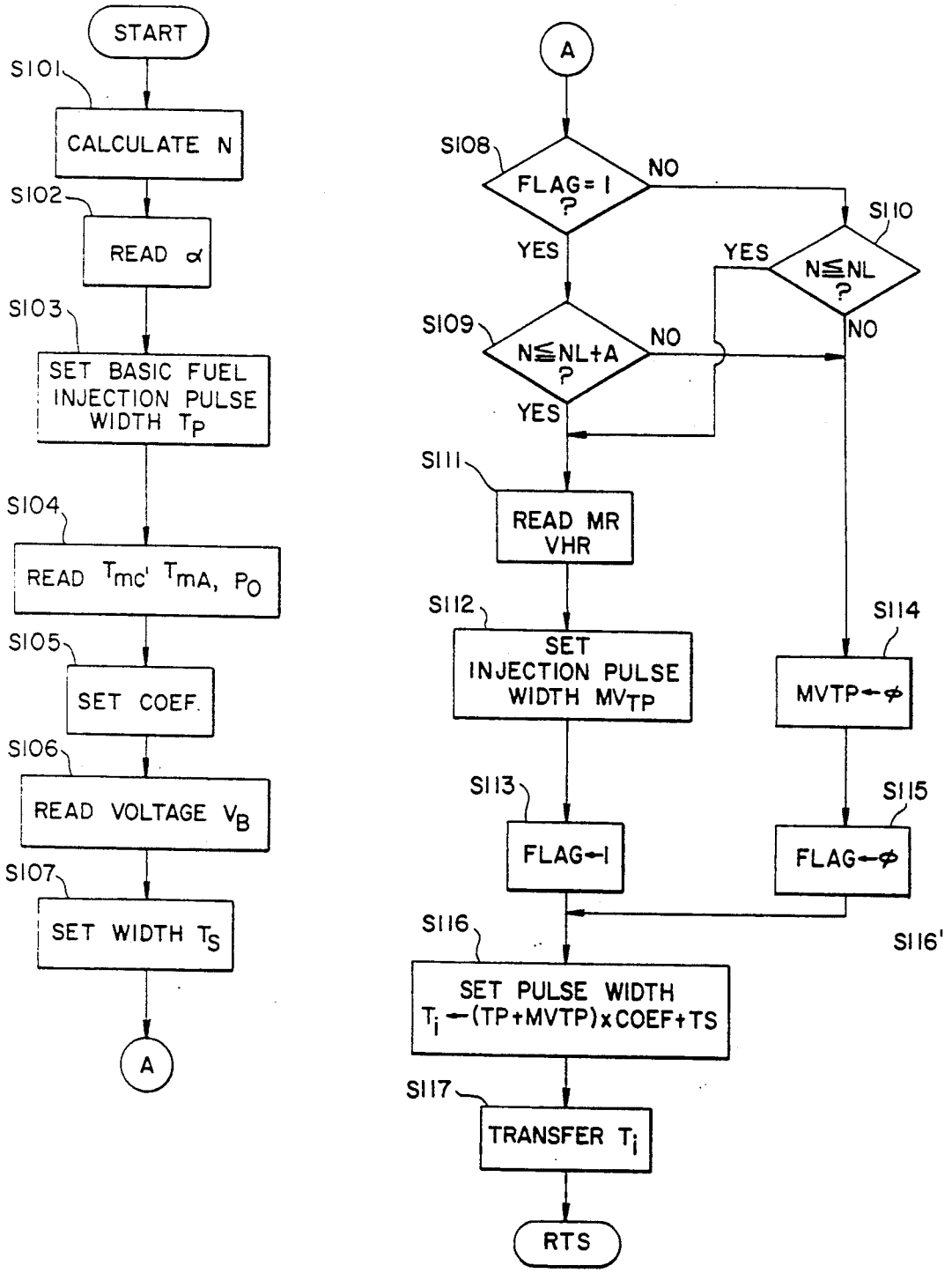
FIG. 7 is a flow chart showing the steps of a fuel injection control.

Now, the steps of controlling fuel injection in the control apparatus 26 constructed as described above will be explained with reference to a flow chart in FIG. 7. Incidentally, the fuel injection control is executed every predetermined crank timing.

First, at a step S101, the period f is evaluated from the input interval of the CDI pulses $(f=dt120°/d\theta120°)$, and the value N of the engine speed is calculated on the basis of the period f $(N=60/(2\pi\cdot f))$. Subsequently, at a step S102, the throttle opening degree $\alpha$ detected by the throttle opening-degree sensor 21 is read.

At a step S103, the basic fuel injection pulse width $T_p$ is set directly or through the interpolational computation in view of the basic fuel injection pulse width map $MP_{TP}$, using as the parameters the engine speed calculated at the step S101 and the throttle opening degree $\alpha$ read at the step S102.

Thereafter, a step S104 reads the crankcase temperature $T_{mC}$ and intake-air temperature $T_{mA}$ respectively detected by the crankcase temperature sensor 20 and intake-air temperature sensor 22, and the atmospheric pressure $P_0$ detected by the atmospheric pressure sensor 4. A step S105 sets the increased-quantity component correction coefficient COEF on the basis of the several parameters.

A step S106 reads the battery terminal voltage $V_B$, and a step S107 sets the injector voltage correction pulse width $T_S$, using the battery terminal voltage $V_B$ as the parameter.

A step S108 discriminates the status of the idling state change-over discriminating flag FLAG, and it is followed by a step S109 for FLAG=1 and by a step S110 for FLAG=0. The idling state change-over discriminating flag FLAG serves to decide if the last routine has discriminated the engine running region as lying in the idling state. The status FLAG=1 indicates the case of the engine running region discriminated as falling within the idling state, while the status FLAG=0 indicates the case of the engine running region discriminated as falling outside the idling state.

When the fuel injection control proceeds from the step S108 to the step S109, the engine speed N calculated at the step S101 is compared with the value (NL+A) obtained by adding the predetermined offset value A to the preset value of the idling deciding reference speed NL (for example, NL=1000 r.p.m.). On the other hand, when the fuel injection control proceeds from the step S108 to the step S110, the engine speed N calculated at the step S101 is compared with the idling deciding reference speed NL mentioned above.

By the way, the offset value A affords the hysteresis which is provided for preventing the control hunting ascribable to the detection error of the engine speed.

In a case where $N\leqq NL+A$ has been decided at the step S109 or where $N\leqq=NL$ has been decided at the step S110, that is, in a case where the engine speed N has been decided as lying within the idling state, the fuel injection control proceeds to a step S111 which reads the terminal voltage $V_{MR}$ of the idling adjustment resistor (MR). Further, a step S112 sets the idling-operation corrected fuel injection pulse width $MV_{TP}$ directly or through the interpolational computation in view of the idling-operation corrected fuel injection pulse width table $TB_{MVTP}$, using the above MR terminal voltage $V_{MR}$ as the parameter.

By the way, the MR terminal voltage $V_{MR}$ can be set at will by turning the adjustment knob 42*b* disposed in the idling adjustment means 42.

At a step S113, the idling state change-over discriminating flag FLAG is set (FLAG←1), whereupon the control proceeds to a step S116.

In contrast to the foregoing, in a case where N>NL+A has been decided at the step S109 or where N>NL has been decided at the step S110, that is in a case where the value N of the engine speed has been decided as lying outside the idling state, the control proceeds to a step S114 which sets the idling-operation corrected fuel injection pulse width $MV_{TP}$ to 0 ($MV_{TP}$←0). Further, a step S115 resets the idling state change-over discriminating flag FLAG (FLAG←∅) and is followed by the step S116.

The step S116 sets the fuel injection pulse width $T_i$ ($T_i=(T_p+MV_{TP})\times COEF+T_S$) on the basis of the basic fuel injection pulse width $T_p$ set at the step S103, the idling-operation corrected fuel injection pulse width $MV_{TP}$ set at the step S112 or S114, the increased-quantity component correction coefficient COEF set at the step S105, and the injector voltage correction pulse width $T_s$ set at the step S107.

Subsequently, at a step S117, the driving pulse which corresponds to the fuel injection pulse width $T_i$ set at the step S116 is output to the injector 14 at the predetermined timing. Then, the routine is ended.

Meanwhile, in case of adjusting the idling speed of the engine, the operator of the system turns the adjustment knob **42*b* disposed in the idling adjustment means 42**, so as to vary and adjust the MR terminal voltage $V_{MR}$, thereby to set the air-fuel ratio and to adjust the idling speed.

It is to be added that the present invention is not restricted to the foregoing embodiments. By way of example, the engine is not restricted to the two-cycle one, but the invention is also applicable to a four-cycle engine.

Besides, the idling-operation corrected fuel injection pulse width may well be calculated as a correction coefficient in the fuel injection pulse width setting, not as the correction value of the quantity of basic fuel injection.

As described above, according to the present invention, the adjustment of idling adjustment means from outside a system makes it possible to easily adjust a fuel injection pulse width in an idling operation and to easily correct the deviation of the measurement of the quantity of intake air attributed to the machining error of a throttle body, the assemblage error of a throttle opening-degree sensor, a secular deterioration or the like. As a result, the invention achieves such an excellent effect that an air-fuel ratio in an idling state can be appropriately set to stabilize idling speed.

What is claimed is:

1. An idling speed adjustment system for an engine having a throttle valve and a fuel injector for injecting fuel into a cylinder of said engine, comprising:

idling speed adjusting means provided to be manually operated by an operator for adjusting an idling speed at an optimum speed which the operator needs and for generating an adjusting signal indicating the adjusting amount of the idling speed, which the operator sets;

engine speed sensing means for detecting an engine speed and for generating an engine speed signal indicative thereof;

throttle opening degree sensing means for detecting an opening degree of said throttle valve and for producing a throttle signal indicative thereof;

first setting means responsive to said engine speed signal and said throttle signal for setting a basic fuel injection pulse width;

discriminating means responsive to said engine speed signal for discriminating an idling state by comparing said engine speed with a predetermined speed;

idling correcting means for calculating a correction value based on said adjusting amount of said adjusting signal when said idling state is discriminated by said discriminating means, said correction value being adapted to correct said basic fuel injection pulse width; and second setting means for setting a fuel injection pulse width to drive said fuel injector based on said basic fuel injection pulse width and said correction value so as to stabilize said engine speed at any idling speed manually adjusted by said idling speed adjusting means.

2. The system according to claim 1, wherein said idling speed adjusting means comprises:

a potentiometer having an adjustment resister and a movable contact, one of said adjustment resister and said movable contact being connected to a battery and the other of said adjustment resister and said movable contact being connected to said idling speed correcting means to supply output voltage corresponding to the position of said movable contact; and an adjustment knob fixed to said movable contact so as to manually change said output voltage for adjusting the idling speed.

3. The system according to claim 2 wherein said idling speed correcting means includes a correction pulse width table from which said correction pulse width is evaluated, using said output voltage as a parameter.

4. The system according to claim 3, wherein said correction pulse width table is adapted to be defined by a function such that a correction pulse width corresponding to output voltage within a predetermined range is set to zero and a correction pulse width corresponding to output voltage outside of said predetermined range is defined between preset upper and lower limit values.

5. An idling speed adjustment system for an internal combustion engine having a fuel injector provided in an intake passage for injecting an amount of fuel into a cylinder of said engine, a throttle valve inserted in said intake passage for controlling an amount of air induced into said cylinder, battery voltage detecting means connected to a battery for detecting a terminal voltage of said battery and for generating a battery voltage signal, a speed sensor for detecting an engine speed and for generating an engine speed signal indicative thereof, a throttle sensor mounted on said intake passage for detecting an opening degree of said throttle valve and for producing a throttle signal indicative thereof, a temperature sensor mounted on a crankcase of said engine for sensing a temperature of said crankcase and for producing a temperature signal, a pressure sensor for sensing an atmospheric pressure and for generating a pressure signal, and an air temperature sensor mounted on said air intake passage for detecting an air temperature of said induced air and for generating an air temperature signal, the system which comprises:

idling speed adjusting means manually operated for adjusting an idling speed at an optimum speed which an operator needs and for generating a voltage signal corresponding to the position of said idling speed adjusting means, which the operator sets;

discriminating means responsive to said engine speed signal for judging an idling state by comparing said engine speed with a predetermined reference speed and for producing an idling signal when said idling state is judged;

idling speed correcting means responsive to said voltage signal and said idling signal for calculating a correction pulse width by referring a fuel injection correcting value table with said voltage signal and for generating a correction pulse width signal indicative thereof;

basic pulse setting means responsive to said engine speed signal and said throttle signal for computing a basic fuel injection pulse width by using a basic fuel injection pulse width map and for outputting a basic fuel injection pulse width signal indicative thereof;

coefficient compensating means responsive to said pressure, said temperature and said air temperature signals for correcting a coefficient used in an equation to calculate said amount of fuel and for outputting a coefficient signal;

voltage correction means responsive to said battery voltage signal for compensating the ineffective injection pulse width of said injector depending on said terminal voltage and for producing a voltage correction signal; and injection pulse deciding means responsive to said basic fuel injection pulse width signal, said correction pulse width signal, said coefficient signal and said voltage correction signal for setting an actual fuel injection pulse width to drive said fuel injector so as to stabilize said engine speed at any idling speed manually adjusted by said idling speed adjusting means.

6. A method for adjusting idling speed of an engine having a throttle valve and a fuel injector for injecting fuel into a cylinder of said engine, the method comprising the steps of:

manually operating an idling speed adjusting device so as to change output voltage therefrom, thereby manually adjusting an idling speed at an optimum speed which an operator needs;

detecting an engine speed;

detecting an opening degree of said throttle valve;

setting a basic fuel injection pulse width based on said throttle opening degree and said engine speed;

judging an idling state when said engine speed becomes lower than a predetermined speed;

calculating a correction value based on said output voltage when said idling state is judged, said correction value being adapted to correct said basic fuel injection pulse width; and setting a fuel injection pulse width to drive said fuel injector based on said basic fuel injection pulse width and said correction value so as to stabilize said engine speed at any idling speed manually adjusted by said idling speed adjusting device.

* * * * *